US005957616A

United States Patent [19]

Fitch

[11] Patent Number: 5,957,616

[45] Date of Patent: Sep. 28, 1999

[54] INERTIAL IMPACT ATTENUATING BARRIER

[76] Inventor: John C. Fitch, 433 Salmon Kill Rd., Lime Rock, Lakeville, Conn. 06039

[21] Appl. No.: 08/917,200

[22] Filed: Aug. 25, 1997

[51] Int. Cl.[6] ..... E01F 13/00; A01K 3/00

[52] U.S. Cl. ..... 404/6; 256/13.1

[58] Field of Search ..... 404/6, 7, 8, 9, 404/10; 256/1, 13.1; 248/27.8, 314, 346.2, 97

[56] References Cited

U.S. PATENT DOCUMENTS 3,606,258 9/1971 Fitch .
3,916,816 11/1975 Fitch ..... 404/9
4,073,482 2/1978 Seegmiller et al. ..... 256/13.1 X
4,225,989 10/1980 Corbett et al. ..... 5/453
4,688,766 8/1987 Zucker ..... 256/13.1
4,934,661 6/1990 Denman et al. ..... 256/13.1
4,973,190 11/1990 Erwin et al. ..... 404/9
5,421,668 6/1995 Cowan et al. ..... 404/6

*Primary Examiner*—William Neuder
*Assistant Examiner*—Sunil Singh
*Attorney, Agent, or Firm*—David A. Tamburro

[57] ABSTRACT

A sacrificial inertial barrier and an array thereof particularly useful on race circuits. The frangible barrier includes a thin walled plastic tub containing an energy absorbing dispersible mass such as water or sand, the tub being supported on a thin-walled plastic ring which elevates the dispersible mass to a height at which its CG is the same as the CG of a particular type racecar, e.g. a Formula I car.

9 Claims, 2 Drawing Sheets

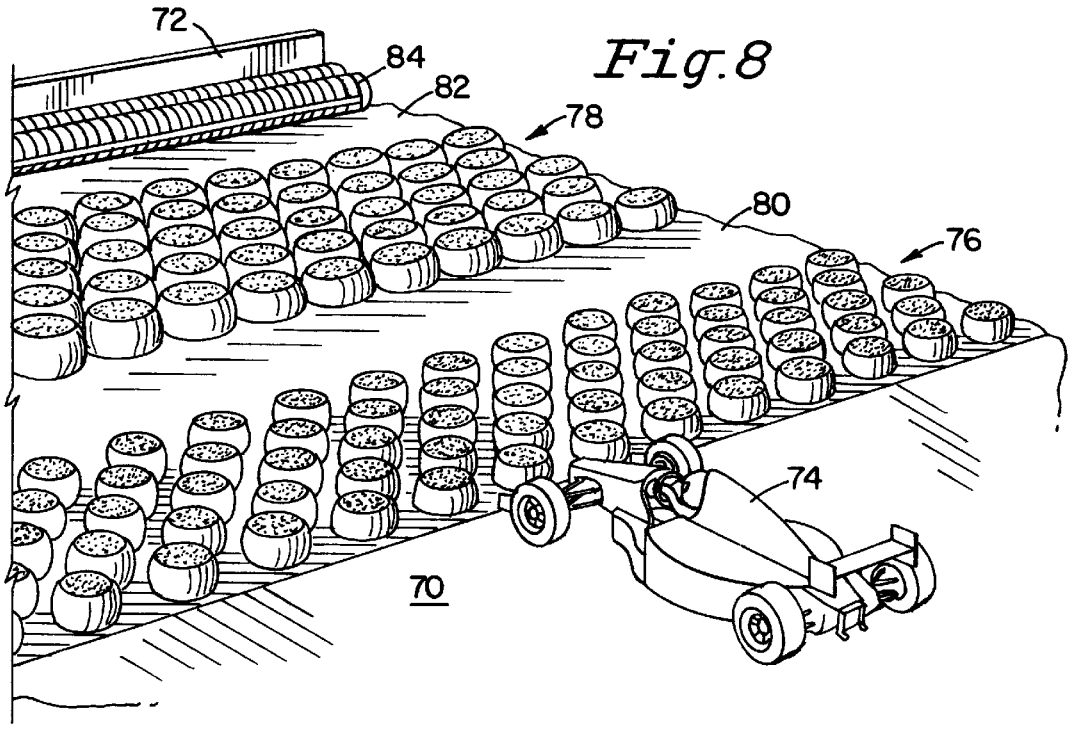
Fig. 8
Fig. 5
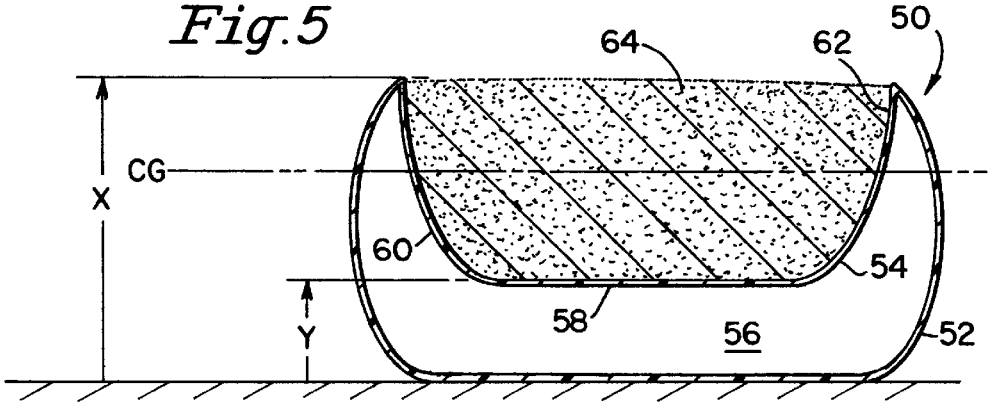
Fig. 6
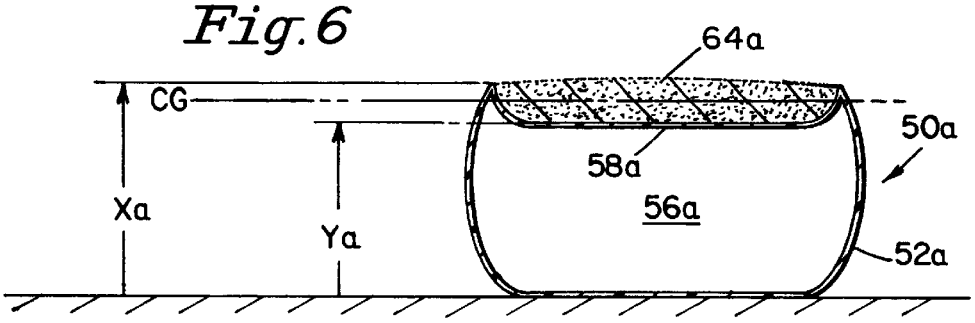

INERTIAL IMPACT ATTENUATING BARRIER

BACKGROUND OF THE INVENTION

This invention relates generally to inertial barriers and more particularly to a novel sacrificial inertial barrier and barrier system especially useful on race circuits to decelerate errant race cars heading towards obstructions such as a wall or a fixed guard rail.

The inertial barrier of the invention is an adaptation of the well known life saving Fitch barrier used on America's highways to decelerate uncontrolled vehicles as they approach immovable obstructions such as bridge abutments. The Fitch barrier is generally illustrated in my earlier U.S. Pat. No. 3,606,258. The inertial barrier of this invention operates on the same exchange of momentum principles discussed in that patent and that discussion is incorporated herein by reference.

Safety systems designed for race circuits must be able to accommodate a wide variety of racecar types, since most circuit operators have to schedule several different kinds of events in order to sustain their commercial operation.

At the top levels, race cars capable of speeds in the region of 200 mph may include Winston Cup stock cars (weighing 3200 lbs), IMSA World Sports Cars (1500 lbs) or Formula I or Indy-car type single-seaters (1100–1550 lb). Those with a 150 mph capability might include Super Touring cars (2100–2300 lb) and Formula 3 single-seaters (1000 lb). In amateur track racing where top speeds are substantially lower, the same circuit may also have to accommodate 100 mph vintage sports cars (weighing approximately 2600 lbs) or H-modified sports racers from the 1950s (700 lbs).

These race cars not only vary in size, speed and weight but also in the height of their center of gravity (CG), and any safety system used must be adjustable to accommodate these variables to safely bring an errant racecar under control. In addition, after an impact, a safety system must be quickly restorable to its original configuration by track personnel so that the race may continue without significant loss of time.

SUMMARY OF THE INVENTION

It is a primary object of the invention to provide a novel inertial barrier and an inertial barrier system capable of satisfying the requirements for race circuits as described above. The inertial barrier system includes a high angle impact, energy-absorbing array of inertial barrier modules capable of arresting a car, e.g. Formula I racecar, from any speed at any angle at a chosen G level without ramping or submarining, with a low risk of injury to the driver, and with minor damage to the car. Each of the modules includes a dispersible mass such as water or sand contained within a sacrificial vessel at a center of gravity corresponding to that of the car, the vessel being designed to disintegrate on impact with the car. Within the array the weight of the dispersible mass in successive modules increases with the direction of travel of the car in order to optimize the inertial forces that will maintain a chosen rate of deceleration or G level as the car progresses into the array.

Another object of the invention is to provide, in a preferred form, a novel inertial barrier module which includes a generally frustoconical, hollow, ground engaging support ring and a separate dispersible mass containing tub resting on the support ring. In each different sized module containing different weights of dispersible mass, the ring and the tub are designed so that the CG of the mass is elevated to match that of the car. The ring and the tub are constructed of the thinnest possible brittle and frangible plastic material which breaks upon impact with a car but produces only little bulk of fragmented parts and thereby prevents a build up of debris under the front of the car and lifting or ramping of the car. Consequently, after impact the area may be quickly cleaned up, the damaged modules replaced, and the array promptly restored to its original design configuration without significant loss of race time.

The novel barrier and barrier system of the invention, although of general utility, has primary application at the end of high speed straights on road racing courses, at pit wall ends on oval tracks, and at the ends of runouts on drag strips.

Other objects and advantages of the invention will become apparent from reading the following detailed description of the invention wherein reference is made to the accompanying drawings.

BRIEF DESCRIPTION OF THE DRAWINGS

FIGS. 5 and 6 illustrate a second embodiment of the barrier of the invention, with the barrier of FIG. 5 containing more dispersible mass than that of FIG. 6;

FIG. 8 is a fragmentary perspective view of the novel inertial barrier of the invention arranged in an array in front of a wall along a race track.

DESCRIPTION OF THE INVENTION

Figure 1:
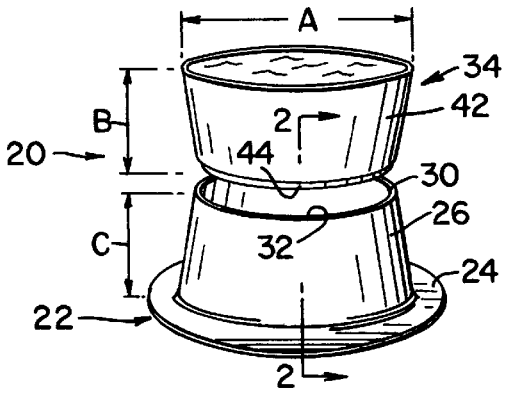
FIG. 1 is an exploded perspective view of the preferred embodiment of the novel inertial barrier of the invention, illustrating the dispersible mass containing tub separated from its support ring.
Figure 2:
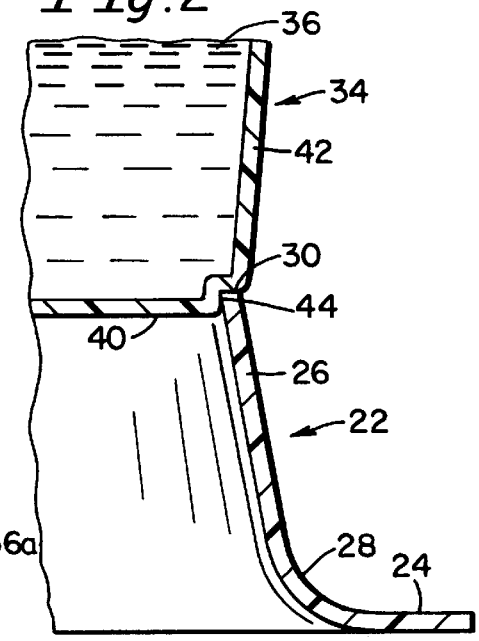
FIG. 2 is a fragmentary sectional view of the tub and support ring of FIG. 2 assembled together in operational form of the barrier.

Referring to FIGS. 1 and 2, the preferred form of the inertial barrier 20 of the invention includes a hollow lightweight brittle plastic support ring 22 having a ground engaging circular horizontal flange 24 and a frustoconical vertical wall 26 joining flange 24 at a flared large radius section 28. Wall 26 has a circular upper edge 30 defining its upper open end 32.

Barrier 20 also includes a separate brittle plastic tub 34 for containing an energy absorbing dispersible mass 36, such as water or sand. Tub 34 includes a circular horizontal bottom wall 40 which joins an upwardly, outwardly tapering circular vertical wall 42 at a peripheral notch or step 44.

When tub 34 is placed on ring 22, edge 30 engages within notch 44 and bottom wall 40 fits down into open end 32 to retain the tub and ring together and center the dispersible mass with respect to the ring.

As mentioned the inertial barriers are provided in different sizes containing different weights of dispersible mass, e.g. 30 lbs water up to 700 lbs sand. When placed in an array the barriers increase in size from the front to the rear of the array in the direction of travel of an errant car. In designing a system for use with Formula I cars which have a CG of about 12 inches, in the smallest barrier 20, tub 34 may have a diameter A of 12 inches, a height B of 7.34 inches, and the mass 36 may be 30 pounds of water. The height C of ring 22 may be 8.3 inches to locate the CG of the mass 36 at 12 inches, the same as that of the car.

Figure 3:
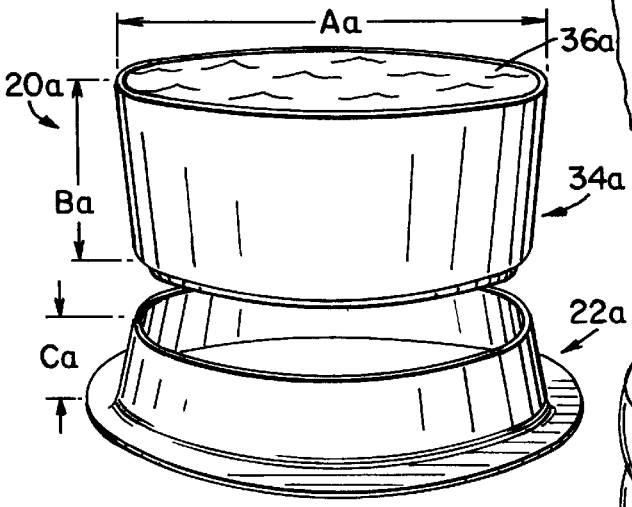
FIGS. 3 and 4 are views similar to FIG. 1, but illustrate barriers larger in size containing greater weights of dispersible mass for sequential placement in an array in the direction of travel of a car.

The barrier 20*a* of FIG. 3 is of the same general construction as that of barrier 20, except it is larger to provide a dispersible mass 36*a* of 200 pounds of water. In barrier 20*a* the tub has a diameter Aa of 24 inches and a height Ba of 12.25 inches. The height Ca of the support ring 22*a* is 5.9 inches to locate the CG of the mass 36*a* at 12 inches, the same as that of the car.

Figure 4:
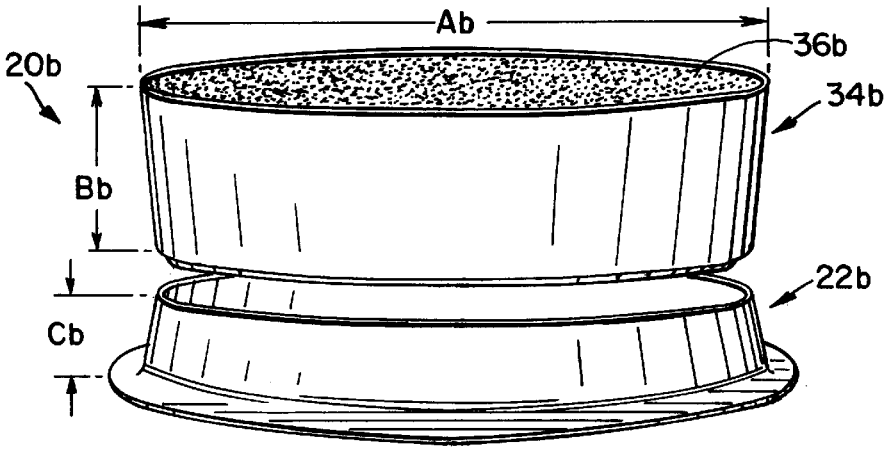

Similarly, the barrier 20*b* of FIG. 4 is of the same general construction as that of barriers 20 and 20*a,* except that it is larger to provide a dispersible mass 36*b* of 700 pounds of sand. In barrier 20*b,* the tub 34*b* has a diameter Ab of 36 inches and a height Bb of 11.8 inches. The height Cb of ring 22*b* is 6 inches to locate the CG of the sand 36*b* at 12 inches, the same as that of the car.

The general configuration of plastic barriers 20, 20*a,* 20*b* provides a number of desirable characteristics and advantages. The brittle plastic tub and ring of the barriers are readily breakable when impacted by a car, and prevent build up of debris under the front of the car, thus avoiding ramping. Debris can be a potential problem because of the low CG of race cars and their minimal ground clearance. Also, the fragmented parts can be quickly cleaned up. Because of the tapers on the walls of the tubs and rings, for each size barrier a plurality of tubs can be nested together and a plurality of rings can be nested together to facilitate shipping and storage of the two components. Also, the tapers on the tub and the ring facilitate their removal from the molds in which they are produced. Further, even though the plastic tubs and rings are of thin wall construction, they are sufficiently strong to resist breakage during normal handling and installation.

Barrier 20 (and similarly barriers 20*a* and 20*b*) is assembled and installed by placing flange 24 of ring 22 on level ground, placing tub 34 on ring 22 with upper edge 30 nesting within notch 44, and then filling the tub with the dispersible mass such as water or sand. The flared flange 24 distributes the weight of barrier 20 over the ground and prevents the ring 22 from sinking into soft surfaces. Notch 44 cooperates with upper edge 30 of ring 22 to hold tub 34 and mass 36 in place on ring 22.

FIGS. 5 and 6 illustrate another embodiment of the invention. The frangible barrier 50 includes an outer thin plastic casing 52 attached to an inner thin plastic casing 54 forming an inflatable air chamber 56 there between. Casing 54 has a bottom wall 58 and a generally spherical sidewall 60 defining an open pocket 62 for receiving a dispersible mass 64 of sand or water.

Barrier 50 represents a 36 inch diameter 700 lb sand module. The overall height X of the module is 18 inches, and the height Y to bottom wall 58 is 6 inches, with the CG of sand mass 64 being 12 inches, the same as that of a Formula 1 car.

Barrier 50*a* represents a 24 inch diameter 50 lb sand module. The overall height Xa is 13 inches, the height Ya to bottom wall 58*a* is 11 inches and the CG of sand mass 64*a* is 12 inches, the same as that of the car.

When impacted by a car, the pressure in chamber 56 and 56*a* increases, causing casings 52 and 54 to burst and sand 64 and 64*a* to disperse.

Figure 7:
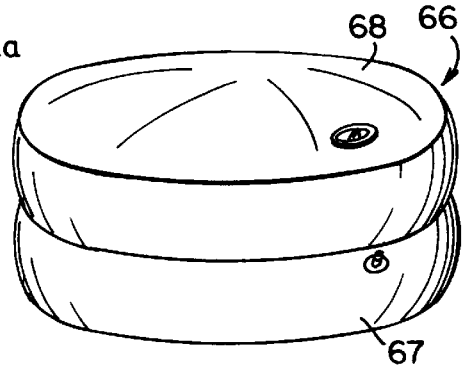
FIG. 7 illustrates a third embodiment of the inertial barrier of the invention.

FIG. 7 illustrates another embodiment of the invention. The frangible module 66 includes a bottom air inflatable support pillow 67 and a separate water fillable bladder or container 68 supported on pillow 67 such that the CG of the water mass is at the same height as the CG of the car. As with the other embodiments, the size of the modules and the weight of water may be varied within an array to accommodate a desired rate of deceleration or G level for an errant car.

Referring to FIG. 8, the modules of the invention are arranged between a race roadway 70 and a fixed wall 72 to arrest an errant car under acceptable G levels. The array includes a first group 76 of smaller modules arranged in progressively increasing values, e.g. 50 lb, 80 lb, 100 lb, from roadway 70 and a second group 78 of larger modules, e.g. 200 lb, 250 lb, 400 lb, and 700 lb masses in progressively increasing values. Modules up to about 250 lb may contain water as the dispersible mass, and modules above 250 lbs will contain sand. They may be arranged in a water-to-sand sequence in order to optimize the inertial values to maintain a desired G level as the car progresses into the array. Water is used in the smaller modules impacted by the car when travelling at its highest speed because water has no shear strength and will follow the aerodynamic contours of the car without lifting. Where the possibility exits of water running onto the racing surface, a shallow water drainage ditch may be provided. An open aisle 80 is left between groups 76 and 78 and an aisle 82 is left between group 78 and a tire barrier 84 placed against wall 72. After impact by an errant car, aisles 80 and 82 provide quick access for rescue personnel and service vehicles. This facilitates clean up of the area and replacement of damaged modules. Thus, the array may be quickly restored to its original configuration without any significant loss of race time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. Sacrificial inertial barrier apparatus for decelerating a vehicle as it approaches a hazardous area comprising at least one frangible barrier module adapted to be positioned in the path of the vehicle in a manner to be freely displaceable upon impact by the vehicle, said module including a frangible upper container having a substantially horizontal bottom wall and a vertical wall joined together at a peripheral notch, said container being at least partially filled with a dispersible mass, a frangible lower hollow support ring having a vertical support wall including a lower portion adapted to rest on the ground and an upper edge defining an upper open end, said upper container being supported on said lower ring with said upper edge of said support wall engaging within said peripheral notch and said bottom wall elevated above the ground, the height of said vertical support wall being such as to locate the center of gravity of said dispersible mass at substantially the same level as the center of gravity of the vehicle.

2. The apparatus according to claim 1, said lower portion of said support ring including a generally horizontal ground engaging flange formed on the bottom of said support wall, said flange distributing the weight of said dispersible mass and preventing sinking of said support wall into soft surfaces.

3. The apparatus according to claim 2, wherein said notch is configured so that when said notch and said upper edge are engaged, said bottom of said container fits within the open end of said vertical support wall.

4. The apparatus according to claim 2, said vertical support wall tapering upwardly and inwardly from said flange.

5. The apparatus according to claim 4, said vertical wall of said container tapering upwardly and outwardly from said bottom wall.

6. The apparatus according to claim 1, said vertical support wall tapering upwardly and inwardly.

7. The apparatus according to claim 1, wherein said notch is configured so that when said notch and said upper edge are engaged, said bottom of said container fits within the open end of said vertical support wall.

8. Sacrificial inertial barrier apparatus for decelerating a vehicle as it approaches a hazardous area comprising a plurality of frangible barrier modules adapted to be positioned in the path of the vehicle in a manner to be freely displaceable upon impact by the vehicle, each of said modules including a frangible upper container having a bottom wall and a vertical wall joined together at a peripheral notch, said container being at least partially filled with a dispersible mass, a frangible lower support ring having a vertical support wall with an upper edge defining an upper open end, said upper container being supported on said lower ring with said upper edge of said support wall engaging within said peripheral notch, the height of said vertical support wall being such as to locate the center of gravity of said dispersible mass at substantially the same level as the center of gravity of the vehicle, said modules being arranged in a pattern of increasing mass in the direction of movement of the vehicle.

9. The apparatus according to claim 8, wherein those modules having less mass contain water and those having greater mass contain sand.

* * * * *